United States Patent [19]

McQuitty

[11] 4,105,537

[45] Aug. 8, 1978

[54] SYSTEM FOR HANDLING THE UNDERFLOW FROM A PRIMARY SEPARATION VESSEL IN THE TAR SAND HOT WATER PROCESS

[75] Inventor: Stanley McQuitty, Ft. McMurray, Canada

[73] Assignees: Her Majesty the Queen in right of Canada, as represented by the Minister of Energy, Mines and Resources, Ottawa; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 774,927

[22] Filed: Mar. 7, 1977

[51] Int. Cl.[2] ..... B01D 12/00; C10G 1/04

[52] U.S. Cl. ..... 208/11 LE; 196/14.52

[58] Field of Search ..... 208/11 LE; 196/14.52

[56] References Cited

U.S. PATENT DOCUMENTS

| | | | |
|---|---|---|---|
| 3,487,003 | 12/1969 | Baillie et al. | 208/11 LE |
| 3,502,565 | 3/1970 | Baillie | 208/11 LE |
| 3,526,585 | 9/1970 | Camp | 208/11 LE |
| 3,607,720 | 9/1971 | Paulson | 208/11 LE |

*Primary Examiner*—Herbert Levine
*Attorney, Agent, or Firm*—E. P. Johnson

[57] ABSTRACT

For operating control and safety, a variable-speed close-coupled pump is direct connected to the underflow of the primary separation vessel (PSV). The desired discharge density of the PSV is 70 - 80% solids in order to minimize bitumen losses. For a good pumping system, the pump discharge density should be less than 65% solids to avoid settling out of the solids in the downstream conduit. Therefore it is necessary to dilute the PSV underflow before it reaches the pump. Secondary flotation tailings, a dilute stream containing a high proportion of fine solids, is used for this purpose. The solids content of the PSV underflow is monitored by one of two alternative systems — a torque recorder on the PSV rake shaft or a density gauge on the PSV underflow conduit. The former is used when the PSV is being fed low fines tar sand — the latter when it is treating high fines tar sand. The close-coupled pump speed is adjusted relative to the solids content measurement to keep it at the desired 70 - 80% level. The density of the stream at the pump discharge is also monitored and the measurement is used to control the amount of secondary flotation tailings added. By the use of the controlled-speed, close-coupled pump, a closed system for controlling underflow density is provided. By using secondary tailings as diluent, water requirements for the process are reduced and a pumpable mixture is provided from which the solids do not readily settle out.

2 Claims, 1 Drawing Figure

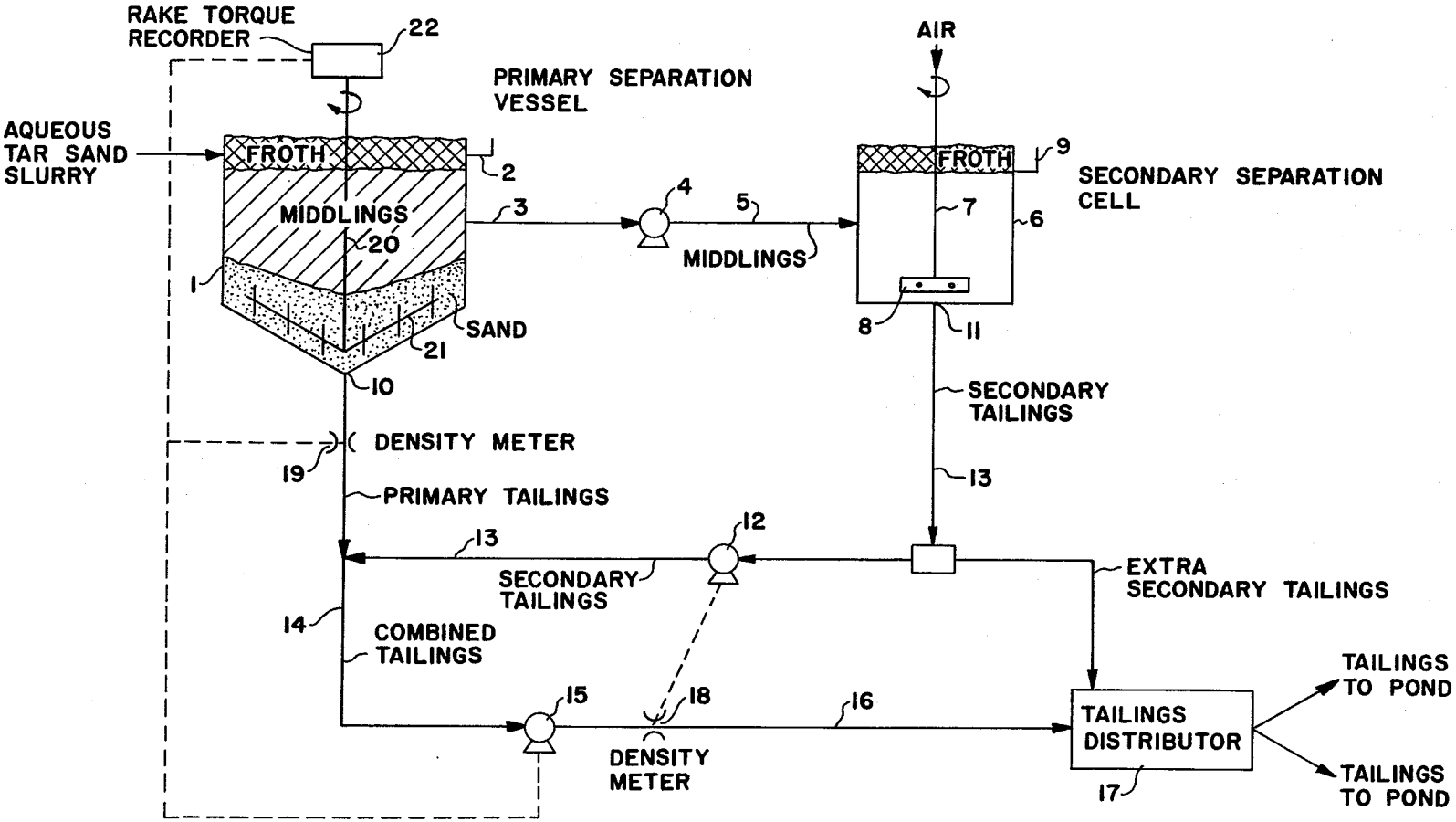
AIR
FROTH
SECONDARY SEPARATION CELL
SECONDARY TAILINGS
EXTRA SECONDARY TAILINGS
TAILINGS DISTRIBUTOR
TAILINGS TO POND
TAILINGS TO POND
MIDDLINGS
PRIMARY SEPARATION VESSEL
SAND
DENSITY METER
PRIMARY TAILINGS
SECONDARY TAILINGS
COMBINED TAILINGS
DENSITY METER
RAKE TORQUE RECORDER
AQUEOUS TAR SAND SLURRY
FROTH
MIDDLINGS

SYSTEM FOR HANDLING THE UNDERFLOW FROM A PRIMARY SEPARATION VESSEL IN THE TAR SAND HOT WATER PROCESS

BACKGROUND OF THE INVENTION

This invention relates to the hot water process for extracting bitumen from tar sand. More particularly, it relates to a system for controlling the density or solids content of the primary separation vessel (PSV) underflow and fluidizing it to render it pumpable and non-plugging.

A large proportion of the world's known hydrocarbon reserves exists in the form of tar sands. One large deposit of this material is found along the banks of the Athabasca River of Alberta. The tar sand exists in the form of water-wet grains of sand, sheathed in a film of bitumen. In treating the tar sand to recover commercially useful products, it is first necessary to separate the bitumen from the water and sand.

The method commonly employed to extract the bitumen from the mined tar sand is known as the hot water process. In the first step of this process, tar sand, hot water and steam are fed into a rotating tumbler and mixed therein. The hot water is supplied at a temperature of about 180° F and in amounts sufficient to supply a slurry containing about 20 - 25% by weight water. The residence time within the tumbler is typically four minutes and the exit temperature of the slurry is about 180° F. While in the tumbler, the tar sand disintegrates and the bitumen particles are liberated from the sand.

The tumbler product is passed through a screen to remove lumps and rocks and is then flooded with additional hot water to further disperse the sand and bitumen particles. A typical flooded, aqueous, aerated slurry will have a composition of 7% bitumen, 43% water and 50% solids, and its temperature will be about 160° - 180° F.

The flooded slurry is then continuously fed into a primary separation vessel. This vessel is conventionally a cylindrical settler having a conical bottom. In the vessel, most of the large sand particles (i.e. plus 200 mesh), fall to the bottom and leave through an outlet as a primary tailings stream. Most of the bitumen particles, rise to the top of the vessel and form primary bitumen froth. This froth overflows the vessel wall into a launder for removal.

A middlings stream, typically comprising about 77% water, 21% solids and 2% bitumen, is continuously withdrawn from the intermediate zone of the primary vessel. The middlings stream is processed in a secondary recovery flotation cell to produce secondary froth and a secondary tailings stream.

SUMMARY OF THE INVENTION

It is desirable to operate the primary separation vessel so as to keep the underflow or tailings relatively dry or dense. This is done to reduce the loss of bitumen with this stream, since bitumen loss increases as the water content of the primary tailings stream increases. In practice, the PSV is operated to try to keep the primary tailings solids content above about 65% by weight, preferably above 70%. A typical primary tailings stream may comprise 30% water, 69.3% solids and 0.7% bitumen. The solids are mainly coarse in nature, as shown in Table I hereinbelow which provides an illustrative particle size analysis.

Due to the high coarse sand content, the primary tailings stream must be diluted to improve its pumpability and to reduce the possibility of the solids settling out and plugging the conduit carrying it to the tailings distribution system.

The secondary tailings stream is a good deal more dilute than the primary tailings stream and carries a large proportion of fine clay and slit solids particles in it. A typical secondary tailings stream comprises 78.4% by weight water, 21.1% solids and 0.5% bitumen. Table 1 shows an illustrative particle size analysis for this stream.

TABLE I

| Size fraction (microns) | Primary tailings | Secondary tailings |
|---|---|---|
| 0 - 5 | 2.6 | 11.8 |
| 5 - 10 | .2 | 10.7 |
| 10 - 20 | 1.5 | 10.4 |
| 20 - 30 | .8 | 4.5 |
| 30 - 44 | 1.4 | 4.3 |
| - 44 | 6.6 | 41.6 |
| 44 - 74 | 3.2 | 10.5 |
| 74 - 147 | 48.1 | 46.0 |
| + 147 | 42.1 | 1.8 |

In accordance with one aspect of this invention, the PSV is operated to produce a dry primary tailings stream. At least part of the secondary tailings stream is combined therewith between the PSV outlet and the pump to produce a single pumpable stream. As a result, the fine solids of the secondary tailings stream help to keep the coarse solids of the primary tailings stream in suspension and process water is conserved.

It is also desirable to provide a responsive and safe system for controlling the rate at which the primary tailings are withdrawn from the PSV. In this connection, a variable-speed close-coupled pump is direct connected to the PSV downcomer conduit and pumps the combined tailings through a line to the tailings distribution system. First means are provided to monitor the solids content of the primary tailings stream. The speed of the pump is controlled in response to said first means to ensure that the solids content of the PSV tailings is maintained close to the desired level.

In a preferred feature, the speed of the close-coupled pump is controlled responsive to the torque on the PSV rake shaft or to the density of the PSV tailings stream. In the case where the PSV is operating on low fines tar sand feed, the torque-sensing system is used. With high fines tar sand feed, the density-sensing system is used.

Second means are provided to monitor the solids content of the combined tailings stream. A variable-speed pump responsive to the second means is provided in the conduit bringing secondary tailings to be mixed with primary tailings. Thus the secondary tailings are used to assist in converting the primary tailings into a pumpable form.

Broadly stated, the invention comprises an improvement in the hot water process for recovering bitumen from tar sand wherein aqueous tar and slurry is fed to a primary separation vessel having a tailings outlet and discharge conduit, through which is produced a relatively dry primary tailings stream mainly comprising coarse solids combined with minor amounts of water and bitumen, and a middlings outlet, through which is produced an aqueous middlings stream which is treated in a secondary recovery flotation cell to produce a relatively fluid secondary tailings stream mainly comprising water containing fine solids, at least part of said secondary tailings stream being combined with said primary tailings stream. The improvement comprises the steps of: monitoring the solids content of the primary tailings stream;pumping at least part of the secondary tailings stream with a variable speed first pump through a first conduit which joins the primary separation vessel discharge conduit to combine said secondary tailings stream with the primary tailings stream; pumping the combined tailings stream through a second conduit with a variable-speed close-coupled pump to deliver it to a tailings distribution system; monitoring the solids content of the combined tailings stream; controlling the close-coupled pump responsive to the solids content of the primary tailings stream to maintain said solids content at a high level to reduce bitumen loss; and controlling the first pump responsive to the solids content of the combined tailings stream to maintain said solids content at a pumpable level.

DESCRIPTION OF THE DRAWING

The FIGURE is a schematic view of the novel system.

DESCRIPTION OF PREFERRED EMBODIMENT

With reference to the Figure, tar sand slurry is introduced into a primary separation vessel 1 of conventional design. In the vessel, floatable bitumen in the slurry rises to the surface of the vessel contents. Here this bitumen forms primary froth which is recovered in the launder 2.

A middlings stream is withdrawn through an outlet 3 intermediate the ends of the vessel by a pump 4 and transferred through the conduit 5 to a secondary separation vessel 6. The vessel 6 is a conventional flotation unit, wherein air is supplied through an agitation shaft 7 to the agitator blades 8. The air becomes dispersed in the middlings in the form of fine bubbles and displaces the bitumen to the surface where it forms secondary froth. This froth is recovered in the launder 9.

Tailings streams are produced from the bottom outlets 10, 11 of the primary and secondary vessels 1, 6. As previously stated, it is desirable to maintain the primary tailings solids content at about 70% — however this is a stream which is difficult to pump and is subject to rapid settling out of solids. Therefore a portion of the secondary tailings, which are relatively dilute, is pumped by a variable-speed pump 12 through a conduit 13 which connects with the downcomer conduit 14 of the primary separation vessel. The secondary tailings mix with the primary tailings to form a dilute stream. The combined tailings stream is pumped by the variable-speed close-coupled pump 15 through the conduit 16 to a tailings distribution 17 for transfer to a settling pond.

A nuclear density gauge 18 establishes a measure of the density or contained solids of the combined tailings stream passing through the conduit 16. This continuous reading is transmitted to a controller on the secondary tailings pump 12 and the speed of the pump is varied to maintain the solids content of the combined stream below 65% by weight, thereby ensuring pumpability and non-plugging of the conduits.

A second nuclear density guage 19 establishes a measure of the density of the primary tailings stream as it leaves the outlet 10. This continuous reading can be transmitted to a controller on the primary tailings pump 15 and the speed of the pump can be varied to maintain the density of the primary tailings stream close to a pre-determined value, i.e. that value corresponding to a solids content of about 70%. This method of monitoring the primary tailings solids content is particularly useful when high fines tar sand is being fed to the circuit.

In the event that low fines tar sand is being fed to the primary separation vessel, it is preferred to establish a measure of the torque on the shaft 20 of the vessel rake 21. A rake torque recorder 22 can be used for this purpose and its signals transmitted to the controller on the primary tailings pump 15. The speed of the pump 15 can thus be varied responsive to these signals to maintain the density of the primary tailings stream at the desired level.

The invention is characterized by several advantages. The use of a close-coupled pump and closed conduit system ensures a responsive and safe operation. The use of the secondary tailings as a fluidizing agent for the primary tailings reduces the possibility of the contained solids settling out downstream. In addition, the water requirements of the process are less than would be the case if fresh water was used, as has been advocated in the prior art. Finally, the control systems used in conjunction with the pumps are particularly responsive.

The embodiments of the invention in which an exclusive property or privilege as claimed are defined as follows:

1. In the hot water process for recovering bitumen from tar sand wherein aqueous tar sand slurry is fed to a primary separation vessel having a tailings outlet and discharge conduit, through which is produced a relatively dry primary tailings stream mainly comprising coarse solids combined with minor amounts of water and bitumen, and a middlings outlet, through which is produced an aqueous middlings stream which is treated in a secondary recovery flotation cell to produce a relatively fluid secondary tailings stream mainly comprising water containing fine solids, at least part of said secondary tailings stream being combined with said primary tailings stream, the improvement comprising the steps of:

monitoring the solids content of the primary tailings stream;

pumping at least part of the secondary tailings stream with a variable speed first pump through a first conduit which joins the primary separation vessel discharge conduit to combine said secondary tailings stream with the primary tailings stream;

pumping the combined tailings stream through a second conduit with a variable-speed close-coupled pump to deliver it to a tailings distribution system;

monitoring the solids content of the combined tailings stream;

controlling the close-coupled pump responsive to the solids content of the primary tailings stream to maintain said solids content at a high level to reduce bitumen loss; and controlling the first pump responsive to the solids content of the combined tailings stream to maintain said solids content at a pumpable level.

2. In combination:

primary separation vessel means for separating bitumen from an aqueous aerated tar sand slurry by flotation to produce and recover a primary bitumen froth stream, a middlings stream comprising water, fine solids and bitumen, and a primary tailings stream containing coarse solids, said vessel means having a tailings outlet at its base and a middlings outlet between its ends;

secondary recovery vessel means for separating bitumen from the middlings stream by aeration and flotation to produce and recover a secondary bitumen froth stream and a dilute aqueous secondary tailings stream containing fine solids, said secondary recovery vessel means having an inlet and a secondary tailings outlet;

means connecting the middlings outlet of the primary separation vessel with the inlet of the secondary recovery vessel for the transfer of the middlings stream therebetween;

first conduit means leading from the primary tailings outlet for the removal of the primary tailings stream;

second conduit means connecting the secondary tailings outlet with the first conduit means at a juction adjacent the primary tailings outlet for delivering at least part of the secondary tailings stream thereto to be combined with the primary tailings stream to form a pumpable mixture;

a first variable-speed pump associated with the second conduit means to pump secondary tailings therethrough;

third conduit means connected with the outlet of the first conduit means for conveying the combined tailings stream to a distribution zone;

variable-speed close-coupled pump means associated with the first conduit means to pump the combined tailings stream through the third conduit;

first means for monitoring the solids content of the primary tailings stream;

second means for monitoring the solids content of the combined tailings stream;

means responsive to the first means for controlling the speed of the close-coupled pump means to maintain the solids content of the primary tailings close to a pre-determined level; and means responsive to the second means for controlling the speed of the first pump responsive to the solids content of the combined tailings stream, whereby the rate at which secondary tailings is added to the primary tailings may be varied to maintain a pumpable combined. tailings stream.

* * * * *